US005613737A

United States Patent [19]

Tseng

[11] Patent Number: 5,613,737

[45] Date of Patent: Mar. 25, 1997

[54] LAWN CHAIR WITH PROTECTIVE ARMREST SLEEVE MEMBERS

[76] Inventor: Chuen-Shyan Tseng, No. 3 Ting-Hsi-Hsin, Lu-Man Tsun, Chu-Chi, Hsiang, Chiayi Hsien, Taiwan

[21] Appl. No.: 560,999

[22] Filed: Nov. 21, 1995

[51] Int. Cl.[6] ..... A47C 1/024

[52] U.S. Cl. ..... 297/463.1; 297/359; 297/28; 297/411.42

[58] Field of Search ..... 297/359, 28, 27, 297/31, 411.42, 411.46, 463.1, 463.2; 403/50

[56] References Cited

U.S. PATENT DOCUMENTS

| | | | |
|---|---|---|---|
| 2,847,060 | 8/1958 | Pearlstine | 297/359 |
| 2,920,686 | 1/1960 | Thomas | 297/359 |
| 4,440,372 | 4/1984 | Wisniewski | 297/344.21 |
| 5,310,246 | 5/1994 | Tseng . | |

FOREIGN PATENT DOCUMENTS

| | | | |
|---|---|---|---|
| 0733801 | 5/1966 | Canada | 297/359 |

*Primary Examiner*—Peter M. Cuomo
*Assistant Examiner*—Anthony D. Barfield
*Attorney, Agent, or Firm*—Brinks Hofer Gilson & Lione

[57] ABSTRACT

A lawn chair includes a backrest frame and two arm support frames provided at two opposite sides of the backrest frame. Each of the arm support frames has an armrest portion and a positioning member secured to the armrest portion and formed with a first longitudinal slot therethrough. A slide plate is sleeved slidably on the positioning member and has a second longitudinal slot unit of predetermined shaped formed therethrough. A positioning bolt extends through the first slot of the positioning member and the second slot unit of the slide plate and is threaded to the backrest frame. A protective sleeve member is sleeved over the armrest portion and is connected securely to the slide plate in such a manner that the protective sleeve member is movable together with the slide plate and that the protective sleeve member encloses the entire length of the positioning member therein. Thus, hands or clothes of the user are prevented from extending into the first longitudinal slot of the positioning member so as to prevent jamming between the positioning member and the slide plate.

1 Claim, 5 Drawing Sheets

LAWN CHAIR WITH PROTECTIVE ARMREST SLEEVE MEMBERS

BACKGROUND OF THE INVENTION

1. Field of the Invention

The invention relates to a lawn chair, more particularly to a lawn chair with protective armrest sleeve members, movement of which relative to the seat frame does not jam hands or clothes of the user.

2. Description of the Related Art

In U.S. Pat. No. 5,310,246, the applicant disclosed lawn chair which includes a backrest frame and two spaced arm support frames provided on two opposite sides of the backrest frame. Each of the arm support frames includes an armrest portion. Two elongated positioning members are connected respectively and securely to the armrest portions of the arm support frames. Each of the positioning members is formed with a first longitudinal slot therethrough which has a front end, a rear end, a pair of upper and lower peripheries that extend between the front and rear ends, and a row of upwardly and rearwardly extending positioning notches that are formed along the upper periphery. Two opposed positioning bolts are respectively mounted to two opposite sides of the backrest frame and extend through the first longitudinal slots of the positioning members so as to engage the positioning notches. Each of the positioning bolts has a neck and an enlarged head. The necks are sized so as to be slidable along the first longitudinal slots. The enlarged heads are sized so as to prevent removal of the bolts from the first longitudinal slots. Each of the positioning members further has a slide plate sleeved slidably thereon. The slide plate has a second longitudinal slot unit of a predetermined shape generally aligned with the first longitudinal slot of the corresponding positioning member and permits extension of the neck of the corresponding positioning bolt therethrough. When the slide plates are moved toward the rear ends of the positioning members, the second longitudinal slots of the slide plates prevent the necks of the positioning bolts from engaging the positioning notches of the positioning members. When the slide plates are moved toward the front ends of the positioning members, the necks of the bolts can engage the positioning notches of the positioning members.

A main drawback resulting from the use of the aforesaid lawn chair is that, when placed accidentally near or in the first longitudinal slot of one of the positioning members, the hand or clothes of the user may be jammed between the slide plate and the positioning member due to angular adjustment of the backrest frame relative to the seat frame.

SUMMARY OF THE INVENTION

Therefore, the main object of the present invention is to provide a lawn chair which has movable armrest sleeve members that guard against jamming of the hands or clothes of the user during angular adjustment of the backrest frame relative to the seat frame of the lawn chair.

The lawn chair of the present invention is generally similar to that of the aforesaid lawn chair except that each of the arm support frames further has a protective sleeve member sleeved over the corresponding armrest portion and connected securely to the corresponding slide plate in such a manner that the protective sleeve member is movable together with the slide plate and that the protective sleeve member encloses the entire length of the corresponding positioning member therein. Thus, the protective sleeve members cover the entire length of the first longitudinal slots formed through the positioning members of the armrest portions and correspondingly prevent hands or clothes of the user from extending into the first longitudinal slots of the positioning members so as to prevent jamming between the positioning members and the slide plates.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 5:
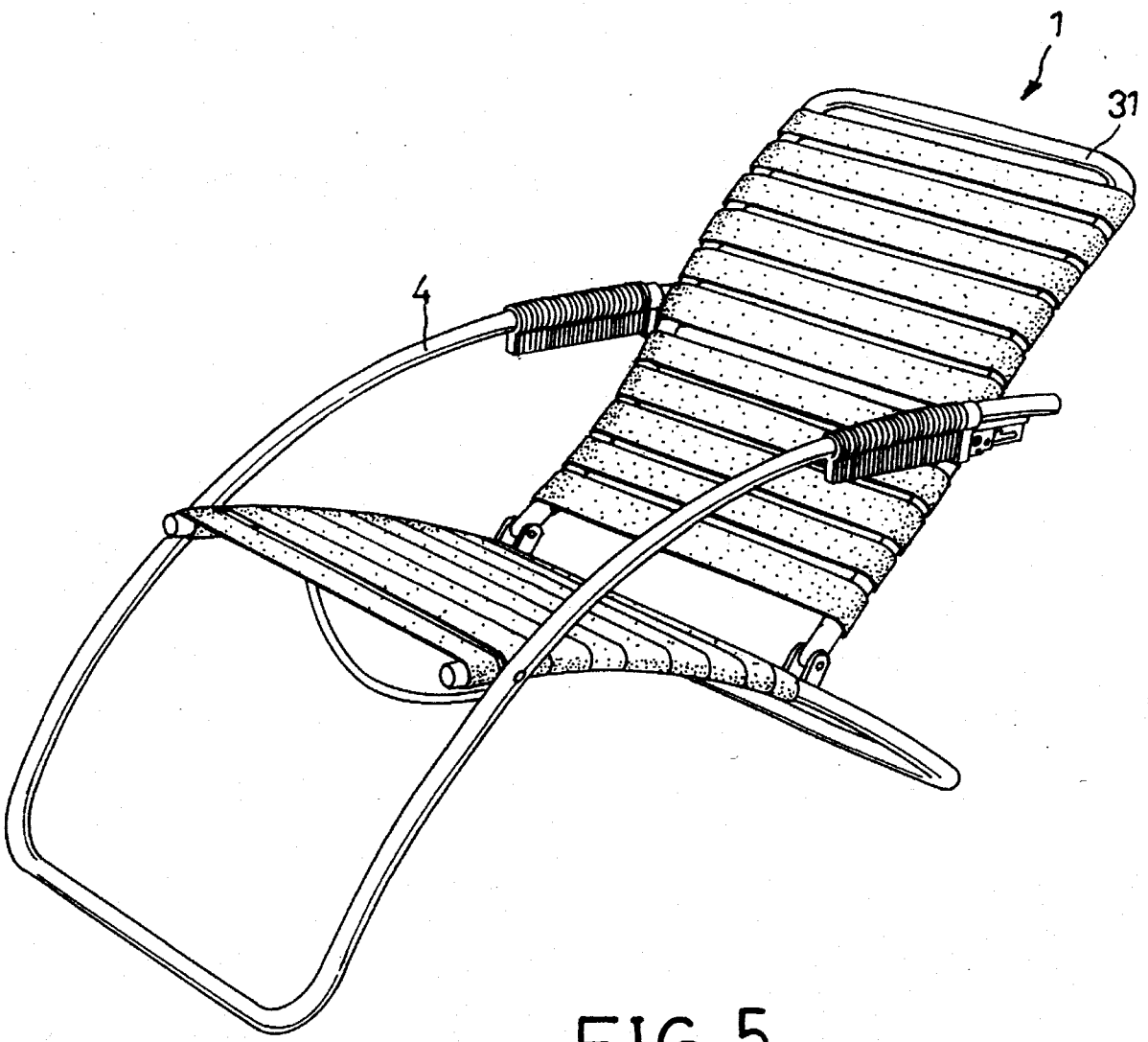
FIG. 5 is a perspective view of the lawn chair of this invention.

Referring to FIG. 5, a lawn chair 1 of this invention includes a backrest frame 31 and two spaced arm support frames 4 provided on two opposite sides of the backrest frame 31.

Figure 1:
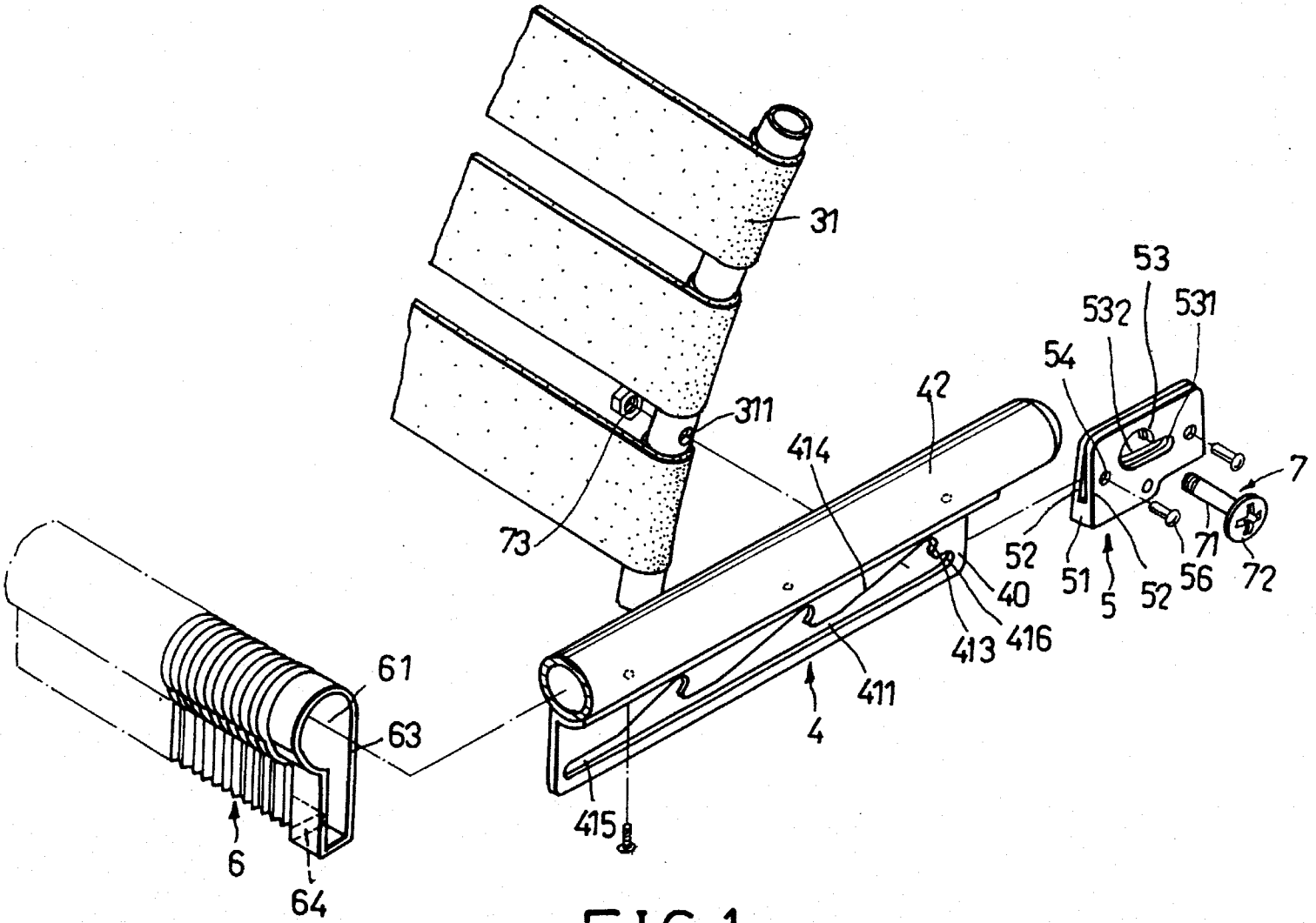
FIG. 1 is a partially exploded view of a portion of a lawn chair of this invention.

As illustrated in FIG. 1, each of the arm support frames 4 includes a cylindrical armrest portion 42, an elongated positioning member 40, a positioning bolt 7, a slide plate 5, and a protective sleeve member 6. The positioning member 40 is connected securely to the armrest portion 42 and has a first longitudinal slot 411 formed therethrough which has a front end 415, a rear end 416, upper and lower peripheries that extend between the front and rear ends 415, 416, and a row of upwardly and rearwardly extending positioning notches 413 which are formed along the upper periphery.

The slide plate 5 has two upper abutting layers 52 sleeved slidably on the positioning member 40 and has a second longitudinal slot unit 53 formed through the abutting layers 52. The second longitudinal slot unit 53 is generally aligned with the first longitudinal slot 411 of the positioning member 40 and consists of a thin rear section 531 and an enlarged front section 532.

The positioning bolt 7 has an enlarged head 72 and a neck 71 extending through the second longitudinal slot unit 53 of the slide plate 5, the first longitudinal slot 411 of the positioning member 40, and the hole 311 of the backrest frame 31 so as to engage a nut 73, thereby fixing the bolt 7 on the frame 31. Thus, the neck 71 of the bolt 7 can engage selectively one of the positioning notches 413 of the positioning member 40. Note that the enlarged head 72 has a size greater than that of the enlarged front section 532 of the second longitudinal slot unit 53 so as to prevent removal of the bolt 7 from the positioning member 40 and the slide plate 5.

Figure 2:
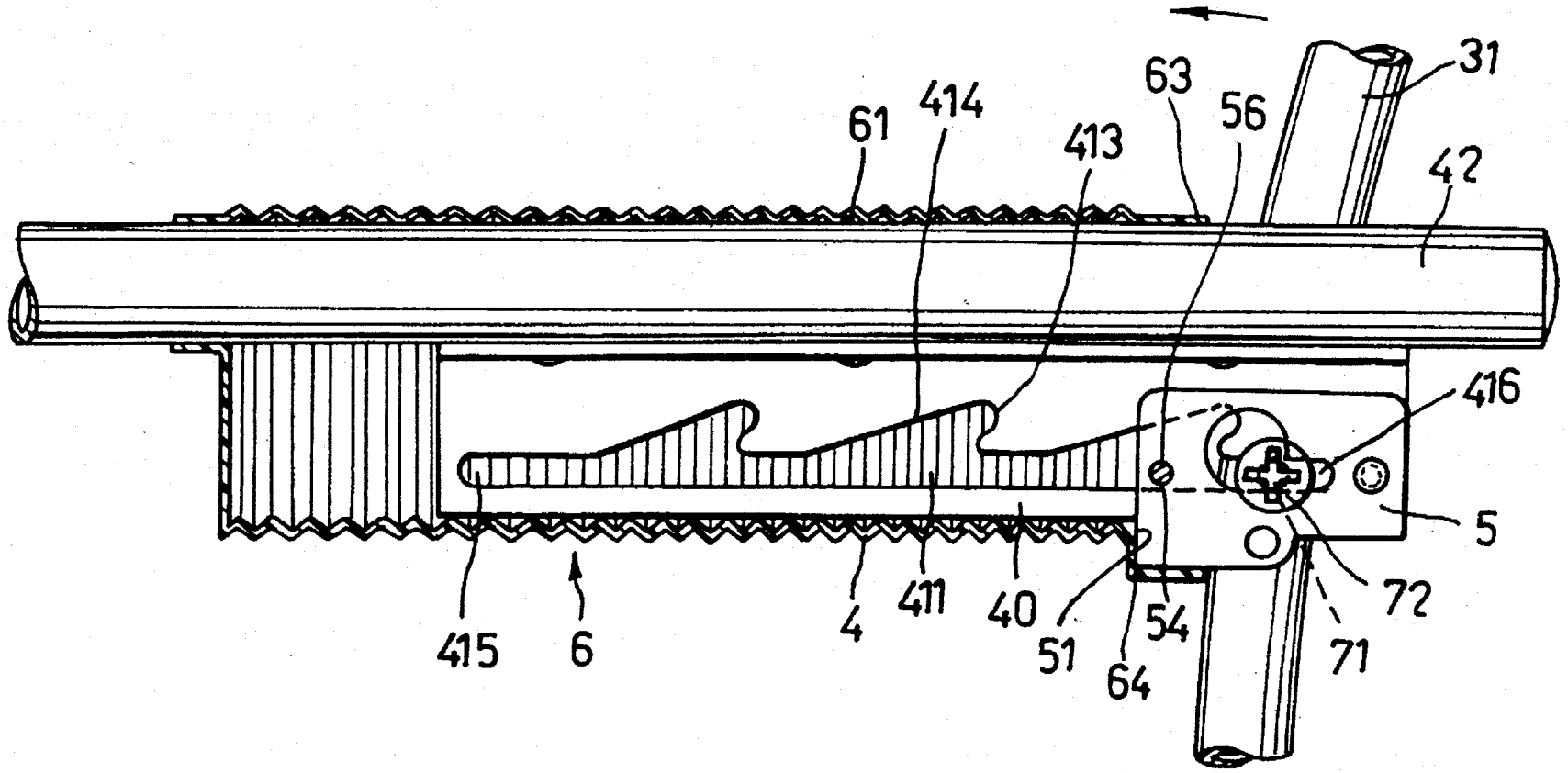
FIG. 2 is a sectional view of an armrest portion of the lawn chair of this invention, wherein the backrest frame is adjusted relative to the armrest portion so as to form a greatest angle therebetween.

Referring to FIG. 2, on either side of the backrest frame 31, the protective sleeve member 6 is sleeved over the armrest portion 42 and the positioning member 40 in such a manner that the sleeve member 6 has a rear end portion 64 abutting against the lower portion 51 of the slide plate 5 and that a front end portion of the slide plate 5 extends partially into the sleeve member 6. A rivet 56 extends through the hole 54 of the slide plate 5 and two opposed walls 61 of the sleeve member 6 so that the protective sleeve member 6 is movable together with the slide plate 5 and that the protective sleeve member 6 encloses in cooperation with the slide plate the positioning member 40 therein, thereby covering the entire length of the first longitudinal slot 411 of the positioning member 40 and correspondingly preventing hands or clothes of the user from being jammed in the first longitudinal slot 411.

Figure 3:
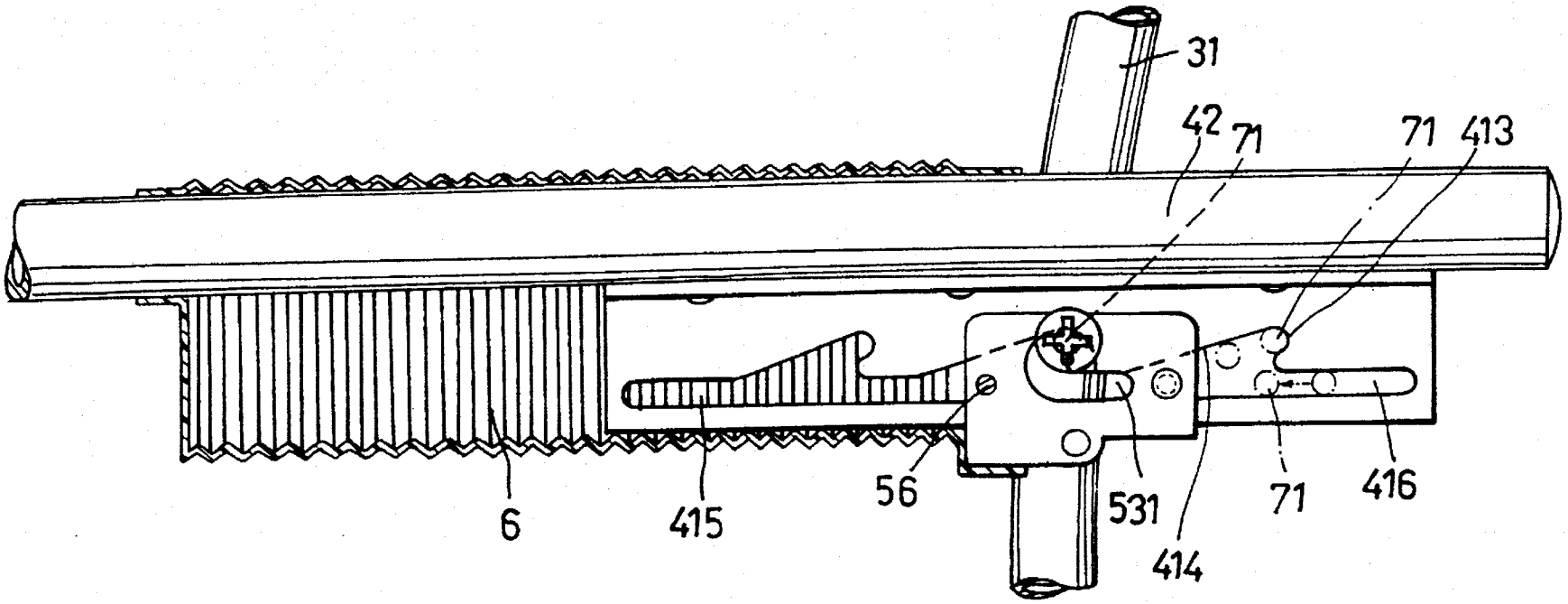
FIG. 3 is a sectional view of the armrest portion of the lawn chair of this invention, wherein the backrest frame is adjusted relative to the armrest portion so as to form therebetween a smaller angle than that shown in FIG. 2.

Referring to FIG. 2, when the user wishes to lean the backrest frame 31 frontward, the positioning bolt 7 can be pushed to a position closer to the front end 415 of the positioning member 40 by the pivotal action of the backrest frame 31 in the direction indicated by the arrow, during which the neck 71 of the positioning bolt 7 is carried on the backrest frame 31 to slide forward along the upper periphery of the first longitudinal slot 411 of the positioning member 40 so as to engage the neck 71 of the bolt 7 in the selected positioning notch 413 of the positioning member 40. As shown in FIG. 3, in the event that the user wishes to lean further frontward, he or she can pivot the frame 31 in the above-mentioned manner, in which the neck 71 of the positioning bolt 7 is pushed downward and frontward along the inclined side 414 of the positioning notch 413 so as to engage the preceding positioning notch 413 of the positioning member 40.

Figure 4:
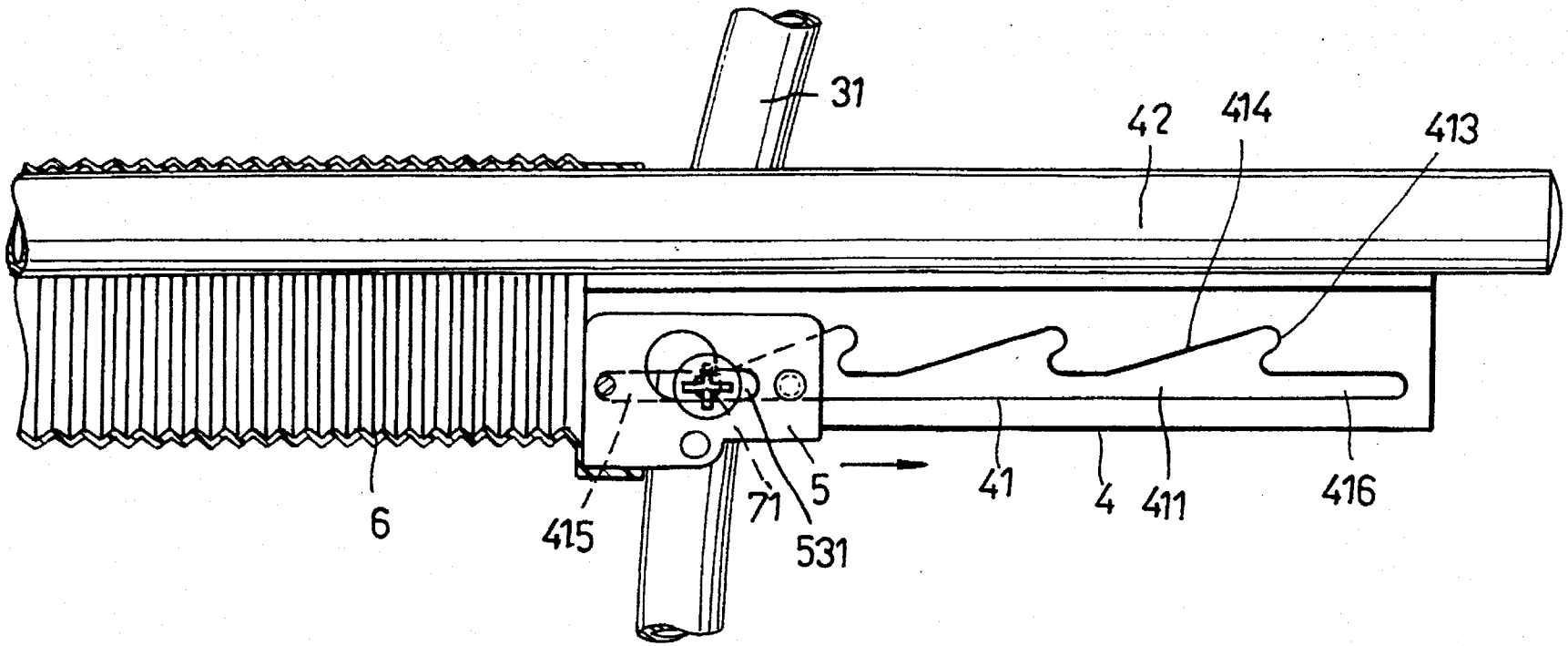
FIG. 4 illustrates how the positioning bolts are prevented from engaging the positioning notches of the positioning members during rearward movement of the backrest frame of the lawn chair of this invention.

As illustrated in FIG. 4, when the backrest frame 31 is moved toward the rear end 416 of the positioning member 40, the neck 71 of the bolt 7 extends through the thin rear section 531 of the second longitudinal slot unit 53 of the slide plate 5 and cannot engage the positioning notches 413 of the positioning member 40.

With the invention thus explained, it is obvious to those skilled in the art that various modifications and variations can be made without departing from the scope and spirit thereof. It is therefore the invention is intended only as in the appended claims.

I claim:

1. In a lawn chair comprising:

a backrest frame, two spaced arm support frames provided on two opposite sides of the backrest frame, each of the arm support frames including an armrest portion, two elongated positioning members connected respectively and securely to the armrest portions of the arm support frames, each of the positioning members being formed with a first longitudinal slot therethrough which has a front end, a rear end and a pair of upper and lower peripheries that extend between the front and rear ends, and a row of upwardly and rearwardly extending positioning notches which are formed along the upper periphery, two opposed positioning bolts respectively and securely mounted to two opposite sides of the backrest frame and extending through the first longitudinal slots of the positioning members so as to engage the positioning notches, each of the positioning bolts having a neck and an enlarged head, the necks being sized so as to be slidable along the first longitudinal slots, the enlarged heads being sized so as to prevent removal of the bolts from the first longitudinal slots, each of the positioning members further having a slide plate sleeved slidably thereon, the slide plate having a second longitudinal slot unit of a predetermined shape and being generally aligned with the first longitudinal slot of a corresponding one of the positioning members to permit extension of the neck of a corresponding one of the positioning bolts therethrough, said second longitudinal slot unit of each of the slide plates preventing the neck of the corresponding positioning bolt from engaging any of the positioning notches of the corresponding positioning member when the slide plate moves toward the rear end of the corresponding positioning member, each of said slide plates permitting engagement of the neck of the corresponding positioning bolt in any of the positioning notches of the corresponding positioning member when the slide plate moves toward the front end of the corresponding positioning member, wherein the improvement comprises:

each of said arm support frames further having a protective sleeve member sleeved over a corresponding one of said armrest portions and connected securely to a corresponding one of said slide plates in such a manner that said protective sleeve member is movable together with the corresponding said slide plate and that, when the arm support frames are in a selected position with respect to the backrest frame, said protective sleeve member encloses in cooperation with the slide plate the entire length of the respective longitudinal slot in the corresponding one of said positioning members, thereby covering said first longitudinal slot of the respective said positioning member and correspondingly preventing hands or clothes of a user from being jammed in said first longitudinal slot.

* * * * *